US010099873B2

(12) United States Patent
Davidson et al.

(10) Patent No.: US 10,099,873 B2
(45) Date of Patent: Oct. 16, 2018

(54) MAGAZINE FOR SHEET PACKAGING ELEMENTS

(71) Applicant: Tetra Laval Holdings & Finance S.A., Pully (CH)

(72) Inventors: Mark W. Davidson, Greer, SC (US); Roy A. Johnson, Marietta, GA (US); Giorgio Santoni, Formigine (IT); Alessandro Morselli, Castelfranco Emilia (IT)

(73) Assignee: Tetra Laval Holdings & Finances S.A., Pully (CH)

( * ) Notice: Subject to any disclaimer, the term of this patent is extended or adjusted under 35 U.S.C. 154(b) by 0 days.

(21) Appl. No.: 15/552,329

(22) PCT Filed: Feb. 26, 2016

(86) PCT No.: PCT/EP2016/054066
§ 371 (c)(1),
(2) Date: Aug. 21, 2017

(87) PCT Pub. No.: WO2016/139137
PCT Pub. Date: Sep. 9, 2016

(65) Prior Publication Data

US 2018/0037431 A1 Feb. 8, 2018

(30) Foreign Application Priority Data

Mar. 2, 2015 (EP) ..... 15157201

(51) Int. Cl.

| | |
|---|---|
| ***B65H 1/02*** | (2006.01) |
| ***B65H 1/30*** | (2006.01) |
| ***B65H 5/02*** | (2006.01) |

(52) U.S. Cl.
CPC ..... *B65H 1/02* (2013.01); *B65H 1/025* (2013.01); *B65H 1/30* (2013.01); *B65H 5/028* (2013.01);
(Continued)

(58) Field of Classification Search
CPC . B65H 1/025; B65H 1/02; B65H 1/30; B65H 2404/3111; B65H 2701/1764; B65H 5/028
(Continued)

(56) References Cited

U.S. PATENT DOCUMENTS 3,999,683 A 12/1976 Langer
4,070,952 A * 1/1978 Linner ..... B65B 59/00 271/150
(Continued)

FOREIGN PATENT DOCUMENTS

WO WO 96-31419 10/1996
WO WO 2010-027524 3/2010

OTHER PUBLICATIONS

International Search Report from corresponding PCT Application No. PCT/EP2016/054066 (2 pages).

*Primary Examiner* — David H Bollinger
(74) *Attorney, Agent, or Firm* — Finnegan, Henderson, Farabow, Garrett & Dunner LLP

(57) ABSTRACT

There is described a magazine (1) for sheet packaging elements (2) in which side portions (4*a*) of said packaging elements (2) are held in a vertical position by transport and support branches (15, 18, 20) of main and secondary units (6, 8, 9) and said packaging elements (2) are advanced in respective conveying spaces (16, 19, 21) along a path (P) parallel to said transport and support branches (15, 18, 20) of said main and secondary units (6, 8, 9). The packaging elements (2) are advanced along said path (P) from an inlet
(Continued)

section (7) to an outlet section (12). During conveying, batches (3) of packaging elements (2) are formed between an accumulation unit (8) and an auxiliary conveying unit (9) so that said packaging elements (2) are advanced in said batches (3) towards an end packaging station.

16 Claims, 8 Drawing Sheets

(52) U.S. Cl.
CPC ..... *B65H 2404/3111* (2013.01); *B65H 2701/1764* (2013.01)

(58) Field of Classification Search
USPC ..... 271/149, 150
See application file for complete search history.

(56) References Cited

U.S. PATENT DOCUMENTS

| | | | | | |
|---|---|---|---|---|---|
| 4,328,962 | A * | 5/1982 | Akers | B07C 3/20 | 271/12 |
| 4,641,489 | A * | 2/1987 | Wood | B65B 27/08 | 271/150 |
| 4,867,432 | A * | 9/1989 | Matta | B65H 1/025 | 270/52.14 |
| 5,244,199 | A * | 9/1993 | Wood | B65H 1/30 | 271/150 |
| 8,540,235 | B2 * | 9/2013 | Kern | B65H 1/025 | 198/465.3 |
| 2003/0015835 | A1 * | 1/2003 | Post | B65H 1/02 | 271/149 |
| 2006/0087071 | A1 * | 4/2006 | Schnuelle | B65B 43/14 | 271/149 |

* cited by examiner

MAGAZINE FOR SHEET PACKAGING ELEMENTS

This is a National Phase of PCT Application No. PCT/EP2016/054066, filed Feb. 26, 2016, which claims the benefit of European Application No. 15157201.3 filed Mar. 2, 2015, both of which are incorporated herein by reference.

TECHNICAL FIELD

The present invention relates to a magazine for sheet packaging elements, in particular for cardboard blanks designed to be transformed into packaging boxes housing multiple packages or containers and adapted to be delivered to sales outlets.

The present invention may be advantageously but not exclusively used in plants for packaging pourable food products, such as beverages, milk, wine, tomato sauce, etc., in sealed packages, containers or the like, which are then packed in groups into the above-mentioned packaging boxes.

The present description refers to this specific field, although this is in no way intended to limit the scope of protection as defined by the accompanying claims.

BACKGROUND OF INVENTION

As known, the said sealed packages or containers are formed, filled and sealed in a machine or a combination of machines and are then conveyed to an end packaging station, in which the sealed packages or containers are packaged in groups into packaging boxes.

Conveniently, packaging boxes are formed from respective sheet packaging elements, which are stored in a magazine and picked up from the latter to be then subjected to folding operations in the end packaging station.

Packaging elements are typically defined by plane, rectangular or square blanks, which, in some cases, may also be provided with handles to ease transportation of the resulting packaging boxes.

Each handle is in general applied to one of the opposite faces of a relative packaging element so as to protrude from the latter. The presence of handles may cause the packaging elements to fan out and so compromise the stackability of the packaging elements in a magazine.

A need particularly felt within the industry is to keep the packaging elements stored in the magazine with given orientations, so that they can be picked up in the right way to be fed to the end packaging station and to be subjected to folding operations in such station.

Another need particularly felt within the industry is to provide a correct distribution of the packaging elements in the magazine irrespective of their initial loading so as to ensure a correct feeding of the packaging elements themselves to the end packaging station.

DISCLOSURE OF INVENTION

It is therefore an object of the present invention to provide a magazine for sheet packaging elements which allows satisfying at least one of the aforementioned needs.

According to the present invention, there is provided a magazine as claimed in claim 1.

BRIEF DESCRIPTION OF THE DRAWINGS

A preferred, non-limiting embodiment of the present invention will be described by way of example with reference to the accompanying drawings, in which.

BRIEF DESCRIPTION OF THE DRAWINGS

Figure 1:
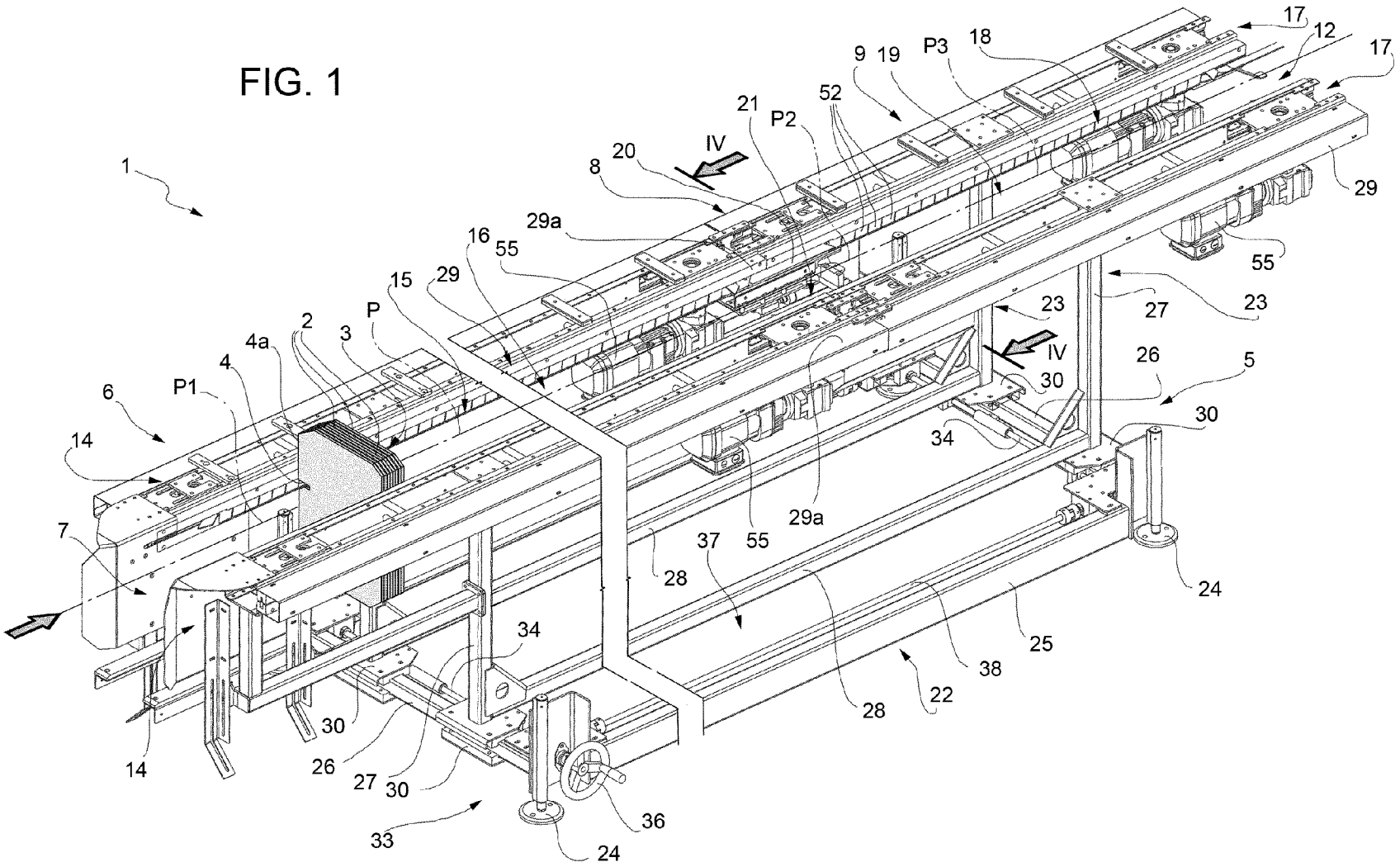
FIG. 1 shows a perspective view of a magazine for sheet packaging elements according to the present invention, with parts removed for clarity.
Figure 2:
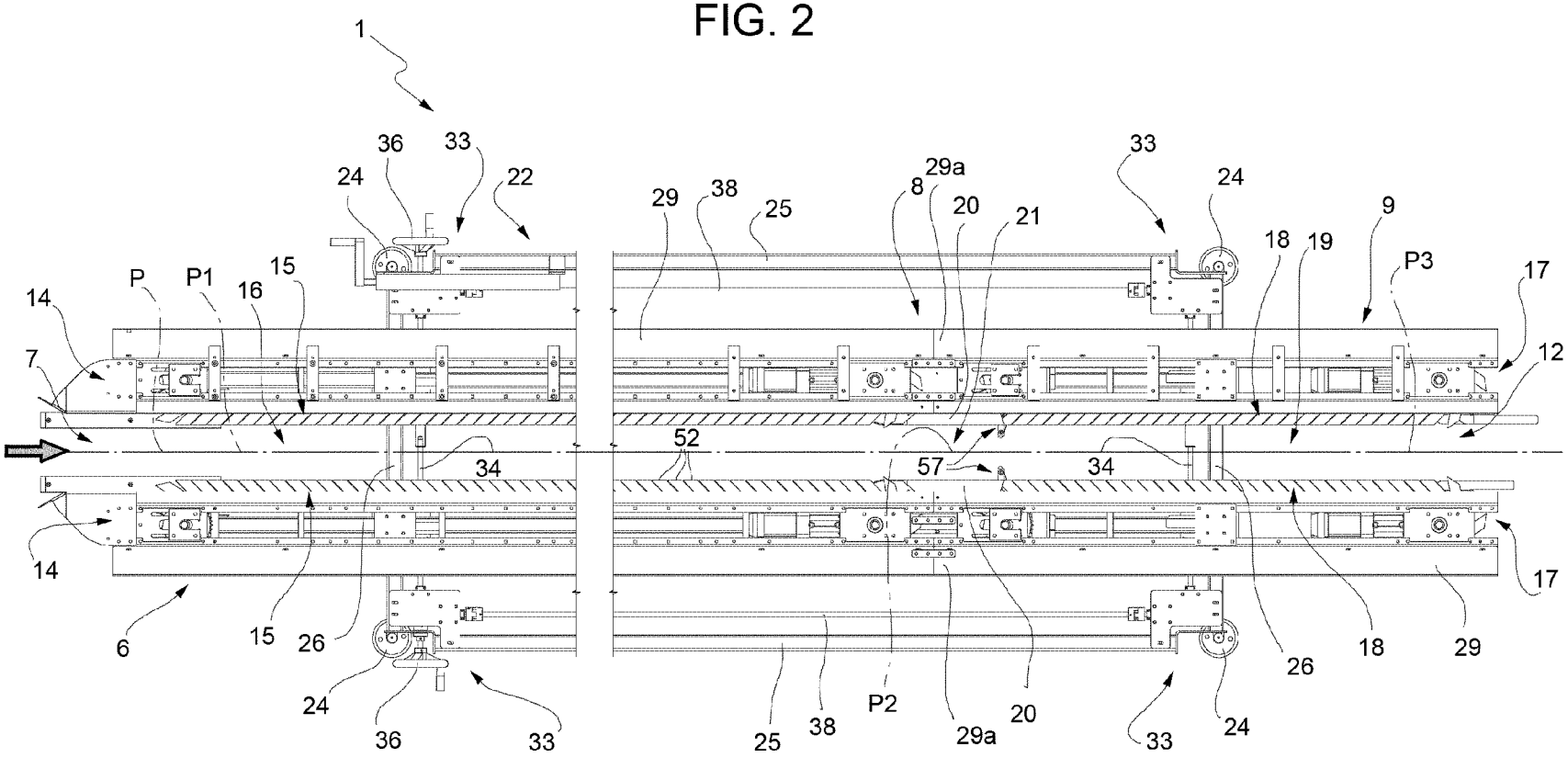
FIG. 2 shows a top plan view of the magazine of FIG. 1, with parts removed for clarity.

Number 1 in FIGS. 1 and 2 indicates as a whole a magazine 1 for sheet packaging elements 2, in particular cardboard blanks designed to be transformed into packaging boxes (known per se and not shown) housing multiple packages or containers (known per se and not shown).

As shown in FIGS. 1 and 2, each packaging element 2 has a plane configuration and presents substantially a rectangular profile. Each packaging element 2 is also provided with at least two lateral cuts or recesses 4, which are formed on opposite sides or edge portions 4*a* of the packaging element 2 and are configured to interact with the magazine 1 as it will be explained in greater detail hereafter.

According to a possible alternative not shown, each packaging element 2 may also comprise a handle protruding from one face of the packaging element 2 or from an edge thereof.

Figure 3:
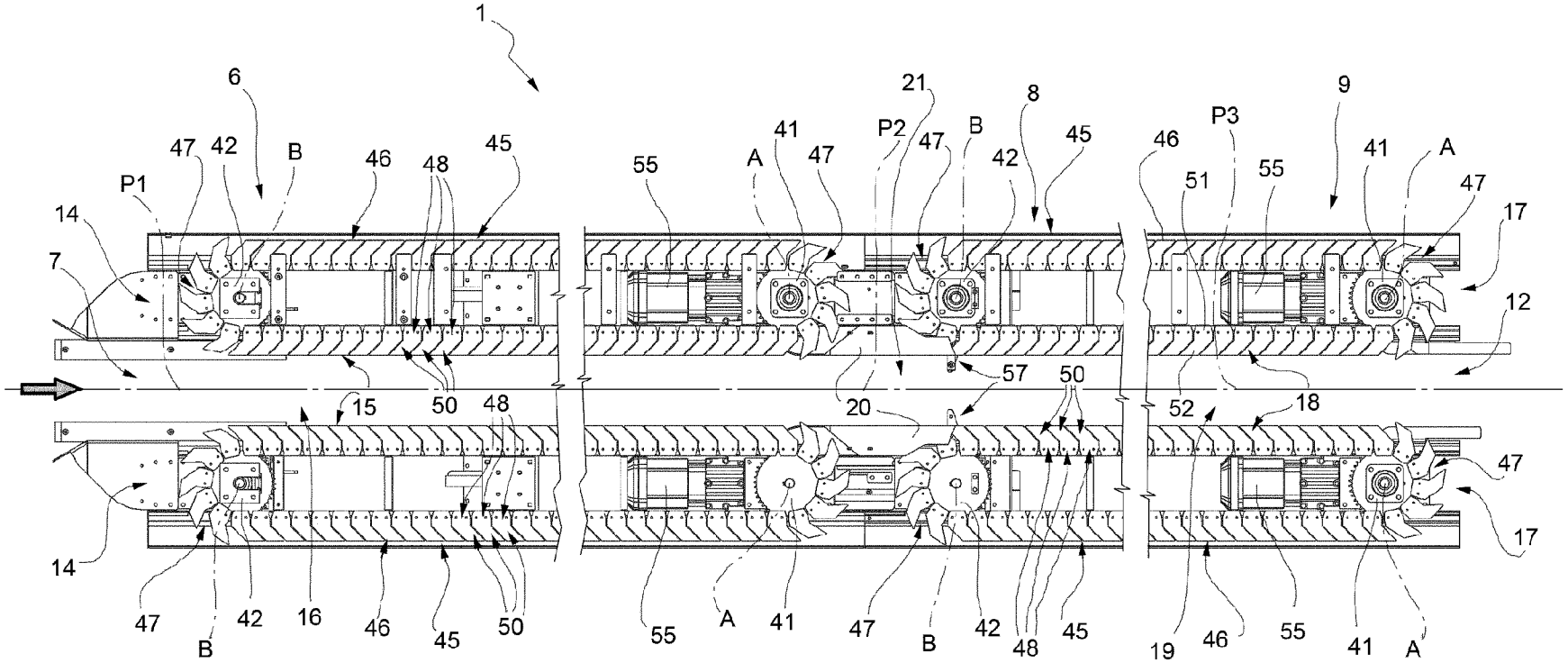
FIG. 3 shows a larger-scale top plan view of the magazine of FIGS. 1 and 2, with parts removed for clarity.
Figure 4:
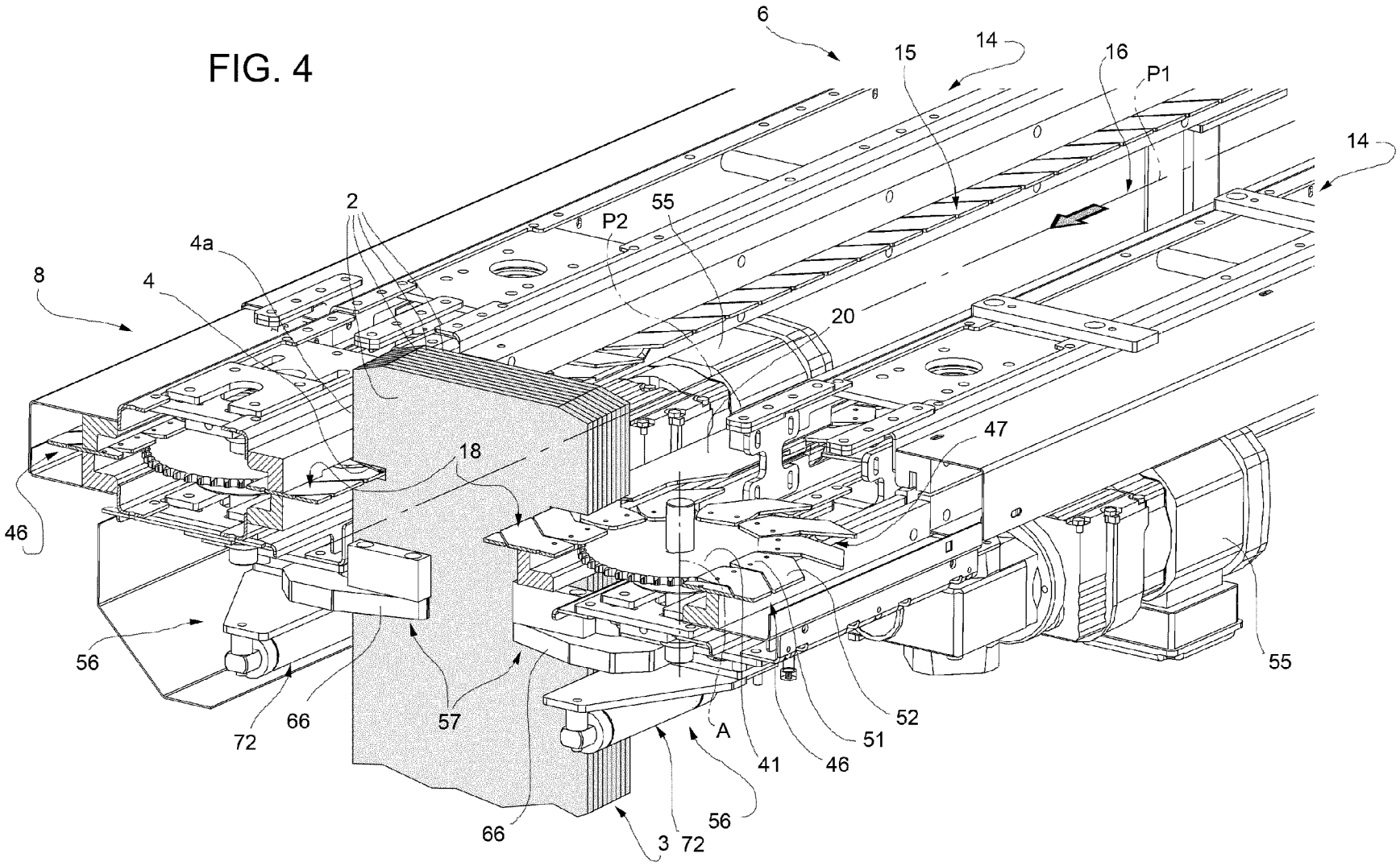
FIG. 4 shows a larger-scale perspective view of a portion of the magazine of FIG. 1, sectioned along plane IV-IV.
Figure 5:
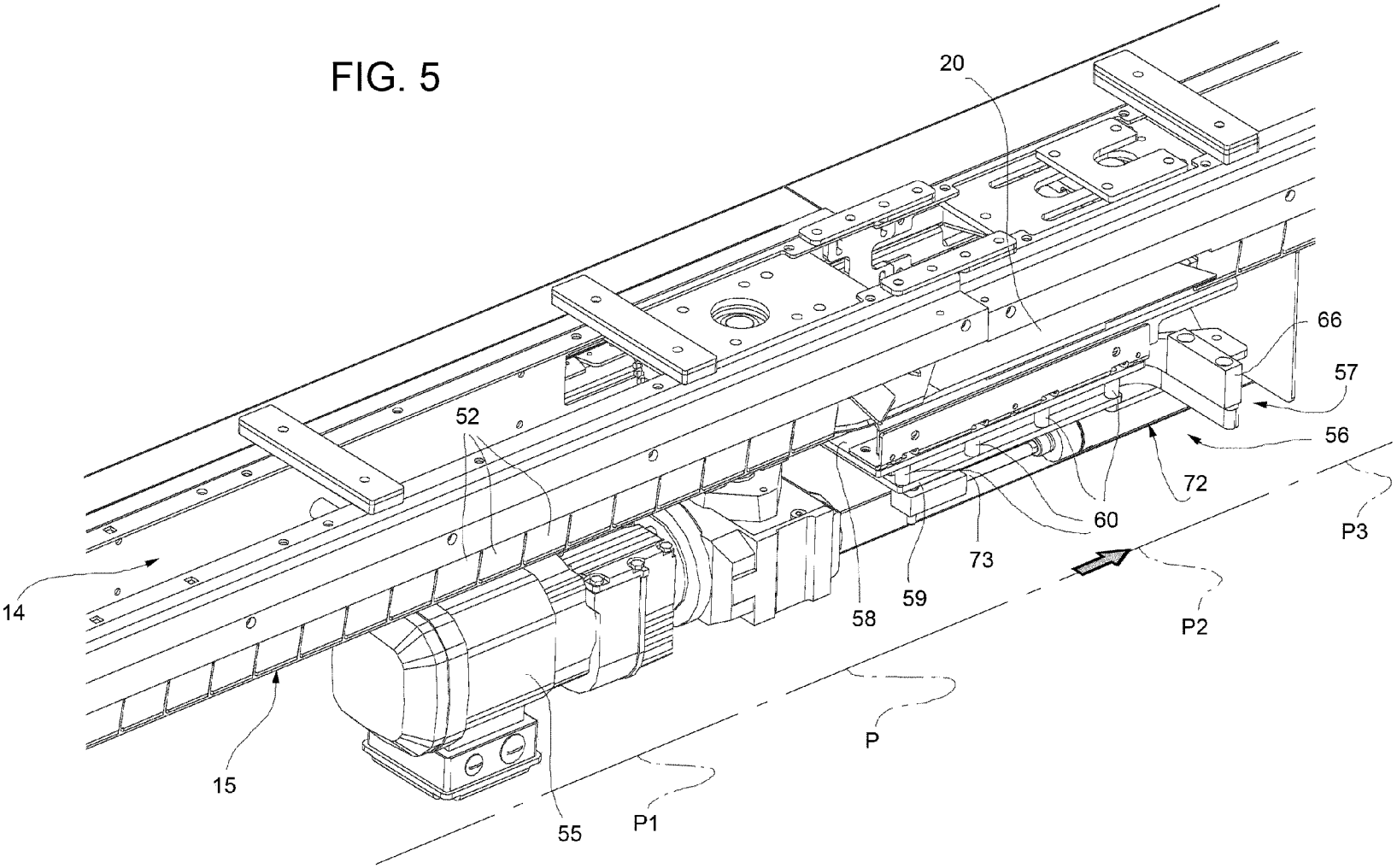
FIG. 5 shows a larger-scale perspective view of a detail of the portion of the magazine of FIG. 4.

With reference to FIGS. 1 to 3, magazine 1 basically comprises:

- a support structure 5;
- a main conveying unit 6 mounted on support structure 5 and receiving packaging elements 2 at an inlet section 7 to advance them within the magazine 1;
- an accumulation unit 8 carried by support structure 5 downstream of main conveying unit 6 and adapted to form multiple spaced batches 3 (only one shown in FIGS. 1 and 4), each defined by a plurality of adjacent packaging elements 2; and
- an auxiliary conveying unit 9 mounted on support structure 5 downstream of accumulation unit 8 and configured to receive spaced batches 3 of packaging elements 2 from accumulation unit 8 and to advance them to an outlet section 12, in which the packaging elements 2 are fed to an end packaging station (known per se and not shown) for folding them so as to form the above-mentioned packaging boxes.

Auxiliary conveying unit 9 is preferably controlled independently from main conveying unit 6.

According to a possible alternative embodiment of the present invention not shown, magazine 1 may comprise solely main conveying unit 6 mounted on support structure 5. In this case, packaging elements 2 should be loaded into magazine 1 in segmented batches 3 having given spacing between each other.

According to another possible embodiment of the present invention not shown, magazine 1 may comprise main conveying unit 6 and two or more auxiliary conveying units 9 arranged downstream of the main conveying unit 6 and separated from each other by respective accumulation units 8. In this case, it would be possible to change the number of packaging elements 2 forming the batches 3 by passing from one auxiliary conveying unit 6 to the following one.

With reference to FIGS. 1 to 3, main conveying unit 6 comprises two main conveyors 14 arranged side by side and having respective horizontal main transport branches 15, in turn defining a main conveying space 16, in which packaging elements 2 are advanced towards accumulation unit 8 and auxiliary conveying unit 9.

In a completely analogous manner, auxiliary conveying unit 9 comprises two auxiliary conveyors 17 arranged side by side and having respective horizontal auxiliary transport branches 18 in turn defining an auxiliary conveying space 19, in which packaging elements 2 are advanced from accumulation unit 8 to outlet section 12. Auxiliary transport branches 18 are aligned with respective main transport branches 15 so as to define respective extensions thereof towards outlet section 12.

Accumulation unit 8 comprises two fixed support branches 20 adapted to support packaging elements 2 in the transition from main conveying unit 6 to auxiliary conveying unit 9 and arranged side by side as well as aligned with respective main transport branches 15 and auxiliary transport branches 18 so as to define an accumulation space 21 interposed between main conveying space 16 and auxiliary conveying spaces 19.

As visible in FIGS. 1 to 3, main conveying space 16, accumulation space 21 and auxiliary conveying space 19 respectively define a first portion P1, a second portion P2 and a third portion P3 of a path P, which extends from inlet section 7 to outlet section 12 and along which packaging elements 2 are conveyed towards the end packaging station.

Path P preferably has a rectilinear configuration parallel to main transport branches 15 and auxiliary transport branches 18 and to support branches 20.

Figure 8:
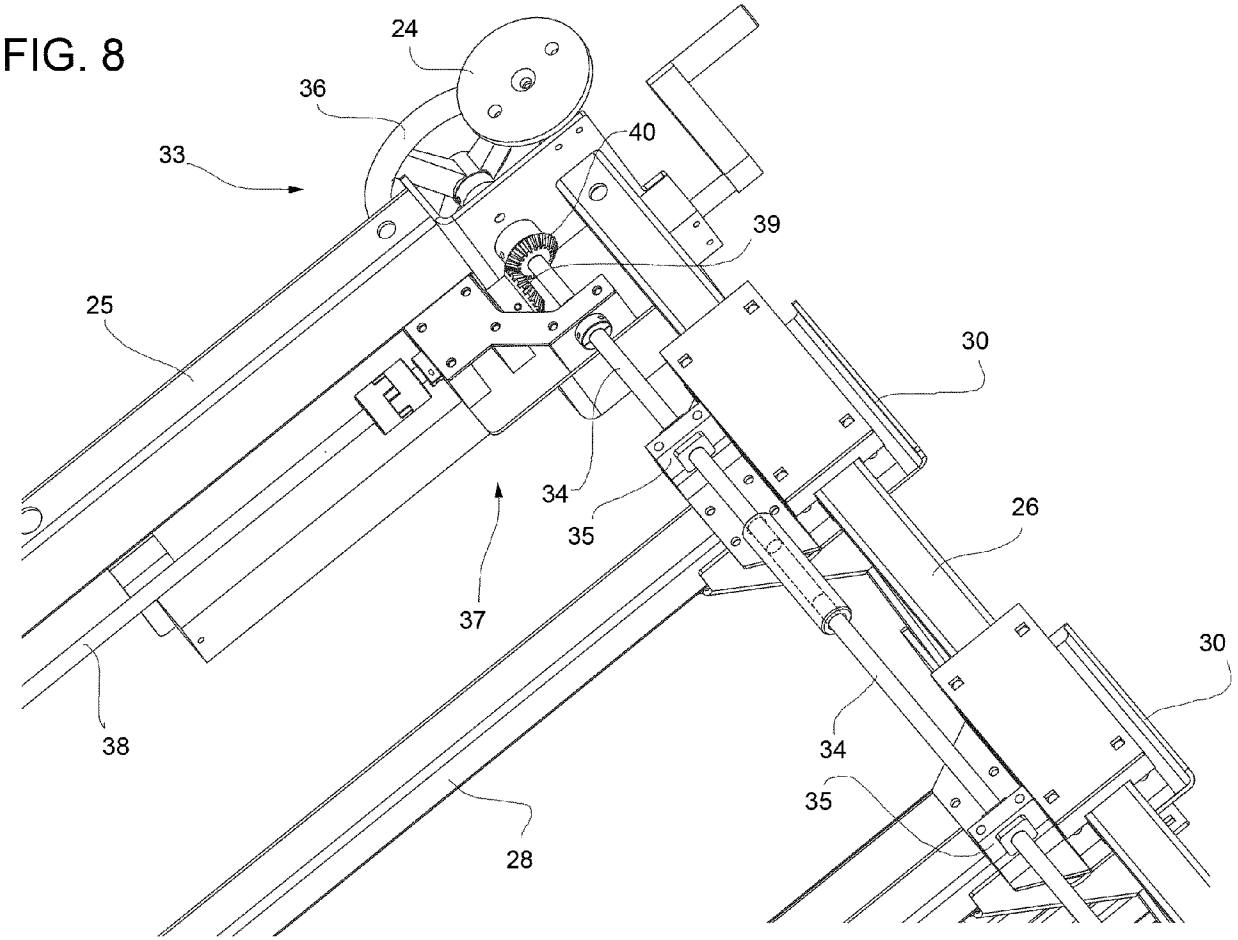
FIG. 8 shows a larger-scale bottom perspective view of another portion of the magazine of FIGS. 1 and 2.

With reference to FIGS. 1, 2 and 8, support structure 5 comprises:

- a fixed horizontal base frame 22; and
- two movable vertical frames 23, each one supporting a relative main conveyor 14 and a relative auxiliary conveyor 17 arranged on the same side with respect to path P.

Base frame 22 rests on the floor through a plurality of height-adjustable feet 24, four in the example shown.

Base frame 22 comprises two longitudinal supporting beams 25 and two transverse supporting beams 26. In particular, longitudinal supporting beams 25 extend parallel to path P and have respective intermediate portions 29*a* carrying fixed support branches 20; transverse supporting beams 26 extend orthogonally to path P and to the longitudinal supporting beams 25.

Each vertical frame 23 is movably mounted on transverse supporting beams 26 of base frame 22 in a direction orthogonal to path P. In this way, by varying the position of vertical frames 23 on base frame 22, it is possible to adjust the width of main conveying space 16 and auxiliary conveying space 19 as well as of accumulation space 21 in a direction orthogonal to path P and as a function of the size of packaging elements 2 handled by magazine 1.

Each vertical frame 23 comprises two vertical struts 27, a lower longitudinal supporting bar 28 and an upper longitudinal supporting bar 29. Vertical struts 27 of each vertical frame 23 are mounted on respective transverse supporting beams 26 by means of respective sliders 30.

Actuator means 33 are provided to move sliders 30 of each vertical frame 23 simultaneously along respective transverse supporting beams 26.

As shown in FIGS. 1 to 3 and 8, each one of the actuator means 33 comprise:

- a screw actuators 34 mounted parallel and adjacent to respective transverse supporting beams 26 and adapted to rotate about their axes; and
- two nut-screw elements 35 secured to respective sliders 30 and engaged by respective threaded end portions of screw actuator 34 to transform the rotation of the screw actuator 34 itself into linear movements of the sliders 30 along the respective transverse support beams 26.

Each one of the actuator means 33 further comprises an operating handle 36 to put into rotation one of screw actuators 34 of the relative vertical frame 23, and a transmission mechanism 37 to transmit rotation imparted by operating handle 36 to the other screw actuator 34.

Transmission mechanism 37 preferably comprises a longitudinal shaft 38, which extends parallel and adjacent to the respective longitudinal supporting beam 25 and has, at its opposite ends, respective bevel gears 39 meshing with corresponding bevel gears 40 carried by respective screw actuators 34.

In particular, bevel gears 40 are mounted on respective end portions of screw actuators 34 opposite the threaded end portions engaging nut-screw elements 35.

With reference to FIGS. 1 to 3, each main conveyor 14 is of chain-type and is mounted on upper longitudinal supporting bar 29 of the respective vertical frame 23.

Each main conveyor 14 comprises a toothed driving pulley 41, a toothed driven pulley 42 and an endless chain 45 wound about respective pulleys 41 and 42.

In particular, pulleys 41, 42 have respective vertical axes A, B parallel to struts 27 of the relative vertical frame 23 and orthogonal to path P and to upper longitudinal supporting bars 25 of the vertical frame 23.

Each chain 45 advantageously lies on a substantially horizontal plane.

Each chain 45 comprises:

- the relative main transport branch 15, which is adjacent to main conveying space 16;
- a main return branch 46, which is parallel to the main transport branch 15 and is arranged on the opposite side thereof with respect to main conveying space 16; and
- curved connection portions 47, which connect respective end portions of the main transport branch 15 to corresponding end portions of the main return branch 46.

Each chain 45 comprises a plurality of links 48 which define respective flaps 50 protruding horizontally into main conveying space 16 when being on the relative main transport branch 15.

Flaps 50 of main transport branches 15 of main conveyors 14 are adapted to engage respective recesses 4 of packaging elements 2 and to support these latter elements in vertical positions (FIGS. 2 and 4), in which they are partially housed in main conveying space 16 and extend orthogonally to the main transport branches 15 themselves and to path P.

More specifically, each flap 50 comprises a root portion 51, connected through rods (known per se and not shown) to the root portions 51 of the adjacent flaps 50, and an engaging portion 52, protruding into main conveying space 16 when being on main transport branch 15 to engage a corresponding recess 4 of a respective packaging element 2.

All flaps 50 preferably lie on a common horizontal plane, which is orthogonal in use to packaging elements 2 advanced by main conveyors 14.

As visible in particular in FIGS. 1 to 3, engaging portions 52 of flaps 50 of main transport branches 15 are inclined with respect to path P. More specifically, the engaging portions 52 of the flaps 50 of one of main transport branches 15 and the engaging portions 52 of the flaps 50 of the other main transport branch 15 are converging to each other in a direction opposite the advancing direction of packaging elements 2 along path P. In this way, support of packaging elements 2 is always guaranteed even in the transition of flaps 50 from main transport branches 15 to the adjacent curved connection portions 47 of the respective chains 45.

As shown in FIG. 1, each main conveyor 14 is actuated by a drive motor 55 fixedly secured to a lower face of the respective upper longitudinal supporting bar 29; in the example shown, motors 55 are located in the vicinity of accumulation unit 8 and are directly coupled to respective pulleys 41.

With reference to FIGS. 1 to 3, auxiliary conveyors 17 present essentially the same configurations as main conveyors 14; for the sake of simplicity and conciseness, all components of auxiliary conveyors 17 are indicated in the Figures with the same numerals as the corresponding ones of main conveyors 14 and are not further described.

In this case, drive motors 55 of auxiliary conveyors 17 are located in the vicinity of outlet section 12.

It is pointed out that drive motors 55 of auxiliary conveyors 17 are controlled independently of drive motors 55 of main conveyors 14.

With reference to FIGS. 4 to 7, accumulation unit comprises stopping means 56 carried by intermediate portions 29*a* of upper longitudinal supporting bar 29, arranged between main conveyors 14 and auxiliary conveyors 17 with respect to path P and selectively actuated to stop in use advancement of packaging elements 2 from main conveying space 16 to auxiliary conveying space 19 in such a way that an accumulation of the packaging elements 2 is generated in use at the exit of main conveying space 16, i.e. in accumulation space 21 and, if necessary, at the outlet region of the main conveying space 16 itself.

Stopping means 56 comprise two stopping elements 57 suspended on the lower faces of intermediate portions 29*a* of respective upper longitudinal supporting bars 29 and movable towards, and away from, each other between an operative position (FIG. 6), in which the stopping elements 57 protrude into accumulation space 21 to interfere with advancement of packaging elements 2 along path P, and a rest position (FIG. 7), in which the stopping elements 57 are retracted from accumulation space 21 and allow movement of the packaging elements 2 along path P.

In particular, each stopping element 57 is sandwiched between a first plate 58, secured to the lower face of the intermediate portion 29*a* of the relative upper longitudinal supporting bar 29, and a second plate 59, secured to the plate 58 at a given vertical distance therefrom to allow movements of the stopping element 57 itself between the rest position and the operative position; more specifically, first plate 58 and second plate 59 are connected to one another by a plurality of spacers 60.

Movement of each stopping element 57 is guided by two slots 61, 62 formed on plate 59 and slidably engaged by respective pins 63, 64 protruding from the stopping element 57 itself.

In greater details, each stopping element 57 is defined by an L-shaped plate parallel to plates 58 and 59. Each stopping element 57 comprises a guiding portion 65, extending—in the rest position—parallel to path P as well as to upper longitudinal supporting bars 29 and provided with pins 63, 64, and a stopping portion 66, extending transversally from an end region of guiding portion 65 and adapted to protrude into accumulation space 21 in the operative position to stop packaging elements 2.

Pins 63, 64 extend orthogonally from the relative stopping element 57 to engage respective slots 61, 62 of plate 59; more precisely, pin 63 protrudes from an end region of guiding portion 65 opposite the end region from which stopping portion 66 extends; pin 64 is instead arranged at an intermediate location of guiding portion 65 between pin 63 and stopping portion 66.

Figure 6:
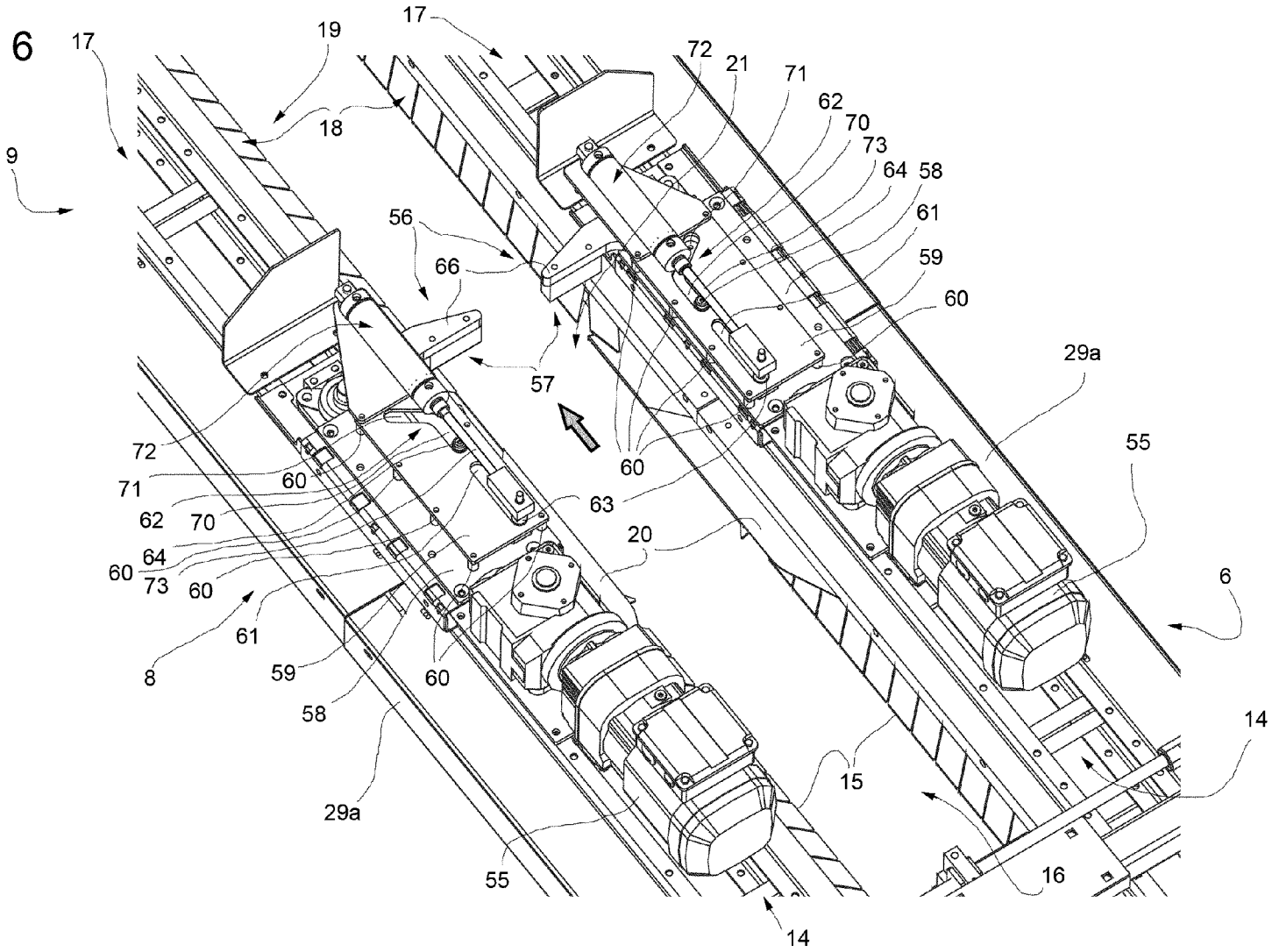
FIGS. 6 and 7 show larger-scale bottom perspective views of the portion of the magazine of FIG. 4, in different operating conditions and with parts removed for clarity.
Figure 7:
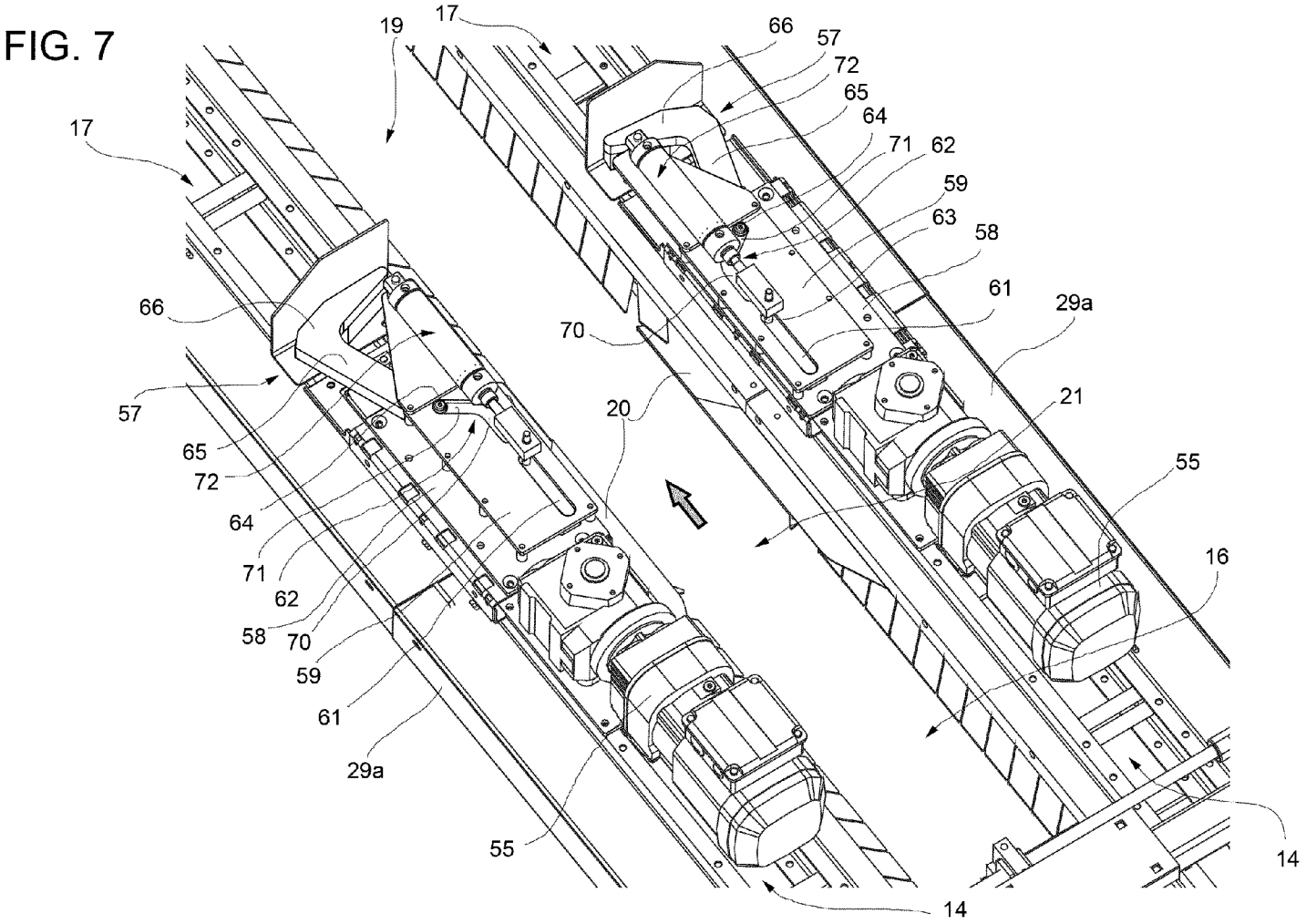

As visible in detail in FIGS. 6 and 7, slot 61 of each plate 59 has a linear configuration and extends parallel to path P and to upper longitudinal supporting bars 29; slot 62 of each plate 59 has a first linear portion 70 aligned with the relative slot 61 and a second linear portion 71, slanted with respect to linear portion 70 and diverging from the linear portion 71 of the corresponding slot 62 formed on the other plate 59 in the advancement direction of packaging elements 2 along path P.

A linear actuator 72, in the example shown a fluidic actuator, is secured to plate 59 on the opposite side of plate 58 and comprises a piston rod 73 moving parallel to path P and having a free end connected to pin 63. Linear movements of piston rod 73 in the opposite directions parallel to path P produce, through interaction of pin 64 with slot 62, movement of the relative stopping element 57 between the rest position and the operative position.

In use, packaging elements 2 are loaded or fed into main conveying space 16 from inlet section 7 of magazine 1. Flaps 50 of main transport branches 15 protruding into main conveying space 16 engage respective recesses of packaging elements 2 and support these latter elements in vertical position. Packaging elements 2 may be loaded or fed into main conveying space 16 at any spacing therebetween.

Prior to loading or feeding packaging elements 2 into magazine 1, the width of main conveying space 16 and correspondingly of auxiliary conveying space 19 and accumulation space 21 may be adapted with respect to the size of packaging elements 2. Each actuating operating handle 36 puts the respective screw actuator 34 to which it is directly coupled into rotation along its longitudinal axis and by means of transmission mechanism 37 also the other screw actuator 34 is put into rotation along its longitudinal axis. Screw actuators 34 cooperate with respective nut-screw elements 35 which move respective sliders 30 along transverse supporting beams 26 orthogonally to path P and therewith also moving the respective vertical frame 23 orthogonally to path P. Vertical frames 23 can be moved independently of each other by actuating the respective operating handles 36; in this way, the upper longitudinal supporting bars 29 and correspondingly main conveyors 14 and auxiliary conveyors 17, are moved towards or away from each other, thus, decreasing or increasing the width of main space 16, auxiliary conveying space 19 and accumulation space 21.

Motors 55 of main conveyors 14, which are synchronized with each other, drive respective pulleys 41, hence, putting into movement respective chains 45; as a consequence, flaps 50 of respective main transport branches 15 are also moved along portion P1 of path P, thereby advancing packaging elements 2 towards accumulation unit 8. In the proximity of accumulation unit 8, flaps 50 of main conveyors 14 release packaging elements 2 which are supported in the same vertical positions by support branches 20.

In this condition, further advancement of packaging elements 2 located in accumulation unit 8 is obtained by the pushing action exerted by the packaging elements 2 upstream of accumulation unit 8 and exiting from main conveying space 16.

Stopping elements 57 may be actuated, simultaneously, from their rest positions to their operative positions by activating respective linear actuators 72 and, thereby, inducing linear movements of respective piston rods 73. In particular, piston rods 73 are moved in opposite directions with respect to path P towards inlet section 7. Correspondingly, guiding portions 65 of stopping elements 57 are moved in cooperation with respective piston rods 73, pins 63, 64 and slots 61 and 62, so that stopping elements 57 are driven to their operative positions, in particular protruding into accumulation space 21.

As set in their operative positions, stopping elements 57 interfere with advancement of packaging elements 2 so as to allow compacting the desired number of packaging elements 2 to form one batch 3. In particular, after having formed the desired batch 3 of packaging elements 2, piston rods 73 of respective linear actuators 72 are moved towards outlet section 12, thereby driving stopping elements 57 into their rest positions.

By continuing to drive motors 55 of main conveyors 14, and consequently the corresponding flaps 50 of main transport branches 15, packaging elements 2 forming the desired batch 3 are pushed from accumulation unit 8 to auxiliary unit 9.

There, in a completely analogous manner, movement of chains 45 of auxiliary conveyors 17 produces advancement of the formed batch 3 of packaging elements 2 along portion P3 of path P towards outlet section 12.

Repeating the above described steps leads to generate a plurality of batches 3 of packaging elements 2 spaced apart from each other and advanced towards the end packaging station for performing the necessary folding operations to form packaging boxes.

The advantages of magazine 1 according to the present invention will be clear from the foregoing description.

In particular, magazine 1 allows conveying packaging elements 2 in an ordered sequence and in vertical position so that a possible presence of handles on the packaging elements 2 would not prejudice stacking of packaging elements 2 as it is the case when packaging elements 2 are e.g. horizontally oriented. In this latter case, stacked packaging elements 2 would inevitably present a tendency to fan out, which may limit further processing.

In addition, debris from packaging elements 2 or other contaminations fall off from the packaging elements 2 during advancement thereof within magazine 1 and, hence, they do not accumulate in between the adjacent packaging elements 2 themselves.

Moreover, functionality of magazine 1 is independent with respect to the way in which packaging elements 2 are loaded or fed into inlet section 7.

In particular, packaging elements 2 may be loaded in main conveying unit 6 at any arbitrary spacing, thereby, simplifying the work of operators. They are advanced along path P towards accumulation unit 8, in which packaging elements 2 become compacted, and, in cooperation with auxiliary conveying unit 9, as described further above, they are grouped in batches 3 having the desired size and numerousness.

Additionally, the number of packaging elements 2 and the spacing between adjacent batches 3 can be varied as a function of the operating conditions of the end packaging station, which receives batches 3 at outlet section 12 and where packaging elements 2 become folded into packaging boxes.

An even further advantage lies in the independent control of drive motors 55 of main conveying unit 6 and auxiliary conveying unit 9 which permit to further adapt the advancement of the batches 3 as well as their spacing to the operation conditions of the end packaging station. Thus, the feeding of batches 3 is not affected by the spacing at which packaging elements 2 are loaded or fed into main conveying unit 6.

In addition, a further advantage arises from flaps 30 having their engaging portions 52 inclined with respect to path P. This allows that packaging elements 2 are continuously supported during transitions from main conveying unit 6 to accumulation unit 8 and from accumulation unit 8 to auxiliary conveying unit 9.

Clearly, changes may be made to magazine 1 as described herein without, however, departing from the scope of protection as defined in the accompanying claims.

The invention claimed is:

1. A magazine system for conveying sheet packaging elements, comprising:

at least two main conveyors arranged side by side and extending in a horizontal direction;

a main conveying space, defined by the at least two main conveyors and located between the two main conveyors, wherein the main conveyors are configured to advance the packaging elements;

wherein each main conveyor further includes:

respective horizontal main transport branches configured to cooperate in use with respective side portions of the packaging elements, so as to support the packaging elements in vertical positions, in which the packaging elements are partially located in the main conveying space and extend transversally with respect to the main transport branches, and to advance the packaging elements along a path parallel to the main transport branches; and at least two auxiliary conveyors arranged side by side and having respective auxiliary transport branches;

wherein each of the auxiliary conveyor are arranged downstream of, and aligned with, the main transport branches so as to define an auxiliary conveying space for the packaging elements received from the main conveying space;

wherein the main conveying space and the auxiliary conveying space define different portions of the path; and wherein the auxiliary conveyors are configured to be controlled independently from the main conveyors.

2. The magazine system as claimed in claim 1, wherein each main transport branch comprises a plurality of engaging portions protruding into the main conveying space and configured to cooperate in use with lateral recesses in the side portions of the packaging elements.

3. The magazine system as claimed in claim 2, wherein the engaging portions of the main transport branches are disposed in a common horizontal plane which is orthogonal, during operation, to the packaging elements.

4. The magazine system as claimed in claim 2, wherein the engaging portions of the main transport branches are inclined with respect to the path.

5. The magazine system as claimed in claim 2, wherein:

the respective horizontal main transport branches of the at least two main conveyors comprise a first main transport branch and a second main transport branch; and the engaging portions of the first main transport branch and the engaging portions of the second main transport branch converge towards each other.

6. The magazine system as claimed in claim 2, wherein:

each main conveyor is a chain-driven conveyor and the engaging portions define at least partially respective links of the main conveyor.

7. The magazine system as claimed in claim 1, wherein the auxiliary transport branches comprise respective engaging portions that protrude into the auxiliary conveying space.

8. The magazine system as claimed in claim 1, and further comprising stopper unit arranged between the main conveyors and the auxiliary conveyors with respect to the path and selectively actuated to stop advancement of the packaging elements from the main conveying space to the auxiliary conveying space such that an accumulation of the packaging elements is generated, during operation, at the exit of the main conveying space.

9. The magazine system as claimed in claim 8, wherein the stopper unit comprises at least one stopping element configured to move between an operative position, in which the stopping element interferes with advancement of the packaging elements, and a rest position, in which the stopping element allows movement of the packaging elements along the path.

10. The magazine system as claimed in claim 9, wherein the stopper unit comprises two stopping elements movable towards, and away from, one another to define the operative and rest positions.

11. The magazine system as claimed in claim 1, further comprising:

two fixed support branches adapted to support the packaging elements in transition from the main conveyors to the auxiliary conveyors and arranged side by side as well as aligned with the respective main transport branches and auxiliary transport branches so as to define an accumulation space interposed between the main space and the auxiliary conveying space.

12. The magazine system as claimed in claim 11, wherein the stopper unit is arranged on opposite sides of the accumulation space.

13. The magazine system as claimed in claim 1, further comprising:

a fixed frame;

two movable frames, each of which is supported by the fixed frame and in turn supports one main conveyor and the respective auxiliary conveyor aligned therewith; and an actuator configured to displace each movable frame in a direction orthogonal to the path so as to change the width of the main conveying space and the auxiliary conveying space in the direction.

14. The magazine system as claimed in claim 13, wherein each movable frame carries a relative one of the fixed support branches.

15. A magazine system for conveying sheet packaging elements, comprising:

at least two main conveyors arranged side by side and extending in a horizontal direction; and a main conveying space, defined by the at least two main conveyors and located between the two main conveyors, wherein the main conveyors are configured for advancing the packaging elements, wherein each main conveyor further includes:

respective horizontal main transport branches configured to: (a) engage with respective side portions of the packaging elements to thereby support the packaging elements in a vertical orientation, such that the packaging elements are partially located in the main conveying space and extend transversally with respect to the main transport branches, and (b) advance the packaging elements along a path parallel to the main transport branches, wherein each main transport branch comprises a plurality of engaging portions protruding into the main conveying space and configured to cooperate in use with lateral recesses in the side portions of the packaging elements to support the packaging elements in the vertical direction, and wherein each main conveyor is a chain-driven conveyor and the engaging portions define at least partially respective links of the main conveyor.

16. The magazine system as claimed in claim 15, wherein the engaging portions are inclined with respect to the parallel path in order to support the packaging elements during transitions from the main conveyor to a downstream auxiliary conveyor.

* * * * *